US006733557B1

(12) United States Patent
Beudon et al.

(10) Patent No.: US 6,733,557 B1
(45) Date of Patent: May 11, 2004

(54) DEVICE FOR DIFFUSING STERILE AIR

(75) Inventors: Didier Beudon, Rambouillet (FR); Pierre Bridenne, Forges-les-Bains (FR)

(73) Assignee: U.N.I.R. Ultra Proprre-Nutrition Industrie-Recherche, Paris (FR)

( * ) Notice: Subject to any disclaimer, the term of this patent is extended or adjusted under 35 U.S.C. 154(b) by 0 days.

(21) Appl. No.: 09/890,140

(22) PCT Filed: Jan. 25, 2000

(86) PCT No.: PCT/FR00/00161

§ 371 (c)(1),
(2), (4) Date: Feb. 4, 2002

(87) PCT Pub. No.: WO00/45097

PCT Pub. Date: Aug. 3, 2000

(30) Foreign Application Priority Data

Jan. 26, 1999 (FR) ..... 99 00817

(51) Int. Cl.[7] ..... B01D 50/00

(52) U.S. Cl. ..... 55/385.2; 55/356; 55/473; 55/DIG. 29; 454/187; 454/188; 454/191

(58) Field of Search ..... 55/385.2, 356, 55/473, DIG. 29; 454/187, 188, 191

(56) References Cited

U.S. PATENT DOCUMENTS 4,189,990 A * 2/1980 Kittler ..... 55/385.2
4,823,680 A * 4/1989 Nowotarski ..... 55/385.2
4,838,150 A * 6/1989 Suzuki et al. ..... 55/385.2
4,851,018 A * 7/1989 Lazzari et al. ..... 55/385.2
4,873,914 A * 10/1989 Hirayama ..... 55/385.2
5,064,457 A * 11/1991 Weber ..... 55/385.2
5,096,477 A * 3/1992 Shinoda et al. ..... 55/385.2
5,425,793 A 6/1995 Mori et al. ..... 55/385.2
5,655,963 A 8/1997 Paschke et al. ..... 454/297

FOREIGN PATENT DOCUMENTS

WO 97/40325 10/1997

* cited by examiner

*Primary Examiner*—Minh-Chau T. Pham
(74) *Attorney, Agent, or Firm*—Foley and Lardner

(57) ABSTRACT

An installation includes a worktop, a first wall and a device for the close protection of products arranged on the worktop, whereby the products are sensitive to contamination from the ambient environment. The products are protected by diffusion of a sterile air stream in a direction substantially perpendicular or parallel to the worktop. The device extends along the worktop and has a least one end adjoining the first wall so that there is an air gap between the end and the first wall. The end is formed by a porous second wall made of perforated material, extending substantially perpendicular to a longitudinal axis of the device, in such a way as to create in the gap a sterile air leakage directed outward away from the worktop, whereby the sterile air leakage counters any ambient air induction into the gap toward the worktop.

20 Claims, 4 Drawing Sheets

DEVICE FOR DIFFUSING STERILE AIR

BACKGROUND OF THE INVENTION

1. Field of the Invention

The present invention relates in general to the close protection of a work station situated in a contaminated atmosphere, and more particularly to a device for the close protection of products which are sensitive to contamination by contaminating agents conveyed by the ambient environment, said products being positioned on a worktop such as a conveyor.

2. Description of the Invention

The ends of a conventional protection device for protecting products that are sensitive to contamination are generally closed by leaktight walls, and the air gap created between the wall and the adjoining end of the device constitutes a risk zone where inductions of contaminated ambient air may occur. The induction of contaminated ambient air produced by suction, consists of a flow of contaminated air directed toward the worktop where the sensitive products are arranged. This contaminated air flow then mixes with the sterile air stream diffused by the protection device and pollutes it.

SUMMARY OF THE INVENTION

The invention finds a particularly advantageous application in the field of the agro-foodstuff or pharmaceutical industry where the products are generally sensitive to the contamination conveyed by the ambient environment during their manufacture, and while they are being transported on a conveyor prior to their packaging.

Such a device according to the invention makes it possible in particular to protect an individual worktop for manufacturing and/or transporting sensitive products such as these, such as a conveyor on which said products are positioned, by diffusing a stream of sterile air in a direction substantially perpendicular or parallel to said conveyor, said device extending along said conveyor.

In certain cases, it may happen that the aforesaid device for close protection has at least one end adjoining a wall so that there is an air gap between said wall and said end.

This wall is for example an outlet wall of a machine such as an oven, rising vertically and having an aperture opening onto said worktop protected by the protection device.

This wall can also be an end wall of another similar device for close protection, abutted with said protection device without mechanical fixing, so as to constitute therewith an assembly for the close protection of a worktop of large length.

To alleviate the drawback of conventional protection devices discussed previously, the present invention proposes a novel device for the close protection of products arranged on a worktop such as a conveyor, which are sensitive to contamination from the ambient environment, by diffusion of a sterile air stream in a direction substantially perpendicular or parallel to said worktop, said device extending along said worktop and having at least one end adjoining a wall so that there is an air gap between said end and said wall, characterized in that said end is formed by a porous wall made of a perforated material, extending substantially perpendicularly to the longitudinal axis of said device, in such a way as to create in said gap a sterile air leakage directed outward away from the worktop, this sterile air leakage countering any ambient air induction into said gap toward said worktop.

According to other advantageous and nonlimiting characteristics of the invention:

a) the device comprises a sheath made of a flexible material diffusing a sterile air stream in a vertical direction substantially perpendicular to said worktop, said sheath being formed of a quasi-leaktight upper wall and of a porous lower wall made of a perforated flexible material, extending longitudinally along the axis of the sheath and delimiting between them a sterile air supply duct, and said end of the sheath being formed by a porous wall made of a perforated flexible material;

b) said end wall and the porous lower longitudinal wall of the sheath are made from a material of like porosity;

c) the perforated flexible material constituting the porous lower longitudinal wall and said end wall of the sheath is a synthetic fabric such as a polypropylene or polyester fabric;

d) each longitudinal edge of the upper longitudinal wall of said sheath is continued by a skirt which extends vertically toward the worktop and which constitutes a means of diffusion of sterile air at high velocity relative to the porous lower longitudinal wall of the sheath which diffuses the sterile air at low velocity;

e) the device comprises a plurality of sheaths made of a flexible material, juxtaposed so that their axes are parallel and arranged in one and the same plane parallel to the worktop, said sheaths covering the entire width of said worktop. According to a preferred variant of this device the external longitudinal edge of the quasi-leaktight upper wall of the sheath situated at each end of the juxtaposition of sheaths, is continued by a skirt which extends vertically toward the worktop and which constitutes a means of diffusion of sterile air at high velocity relative to the porous lower walls;

f) the two skirts of the sheath or of the juxtaposition of sheaths are of the same length and extend up to the immediate proximity of the worktop;

g) the two skirts of the sheath or of the juxtaposition of sheaths have different lengths, a long skirt whose length is approximately equal to the height allowed for between the axis of the sheath and the worktop and a short skirt whose length is approximately equal to half the length of the long skirt;

h) the device comprises at least one ventilation nozzle arranged on a longitudinal edge of said worktop and able to produce directed toward said products a sterile air stream in a horizontal general direction substantially parallel to said worktop, said ventilation nozzle comprising at its outlet an air diffuser made of a perforated material provided with upper and lower parts which produce an anti-inductive air flow whose velocity of diffusion exhibits a component normal to the worktop, said end of said ventilation nozzle being formed by a wall made of a perforated material;

i) said end wall of the ventilation nozzle and the upper part and lower part of the air diffuser are made from perforated sheet of like porosity;

j) the ventilation nozzle comprises at the level of said porous end, on its upper surface extending horizontally up to its outlet, a strip of perforated material forming a sterile air flow directed essentially vertically away from the worktop;

k) the device consists of a cubicle positioned above the worktop, supplied with sterile air and having a porous lower wall for diffusing sterile air in a vertical direction substantially perpendicular to the worktop, said porous wall being made of perforated sheet and exhibiting a profile such that it ensures central diffusion of sterile air at low velocity bordered on each side by a diffusion of sterile air at high velocity, said end of the cubicle being formed by a wall comprising at least one porous zone made of a perforated material extending over the entire width of said cubicle and rising from the lower edge of said cubicle to a certain determined height.

The invention also proposes an assembly for the close protection of products arranged on a worktop such as a conveyor, which are sensitive to the contamination conveyed by the ambient environment, characterized in that it comprises a device according to the invention as defined in characteristics a) to f) and at the extremity of said device, at least one ventilation nozzle arranged on a longitudinal edge of said worktop, able to produce directed toward said products a sterile air stream in a horizontal general direction substantially parallel to said worktop, said ventilation nozzle comprising at its outlet an air diffuser made of perforated material comprising upper and lower parts which produce an anti-inductive air flow whose velocity of diffusion exhibits a component normal to the worktop, said device furthermore comprising at the junction with said ventilation nozzle a vertical end skirt extending in a plane perpendicular to the planes of the lateral skirts of said sheath, directed toward said worktop up to a determined distance therefrom so as to permit the passage of said products under said end skirt.

It further proposes an assembly for the close protection of products arranged on a worktop such as a conveyor, which are sensitive to the contamination conveyed by the ambient environment, characterized in that it comprises a device according to the invention as defined in characteristics a) to e) and g) and at the extremity of said device, at least one ventilation nozzle arranged on a longitudinal edge of said worktop, able to produce directed toward said products a sterile air stream in a horizontal general direction substantially parallel to said worktop, said ventilation nozzle comprising at its outlet an air diffuser made of perforated material comprising upper and lower parts which produce an anti-inductive air flow whose velocity of diffusion exhibits a component normal to the worktop, said device furthermore comprising at the junction with said ventilation nozzle a vertical end skirt extending in a plane perpendicular to the planes of the lateral skirts of said sheath, directed toward said worktop up to a determined distance therefrom so as to permit the passage of said products under said end skirt.

The description which follows in conjunction with the appended drawings given by way of nonlimiting examples will elucidate the gist of the invention and the manner in which it may be embodied.

DETAILED DESCRIPTION OF THE INVENTION

It will firstly be noted that elements which are identical or similar in the various embodiments represented will so far as possible be referenced by the same reference signs from one figure to another and will not be described each time.

Figure 1:
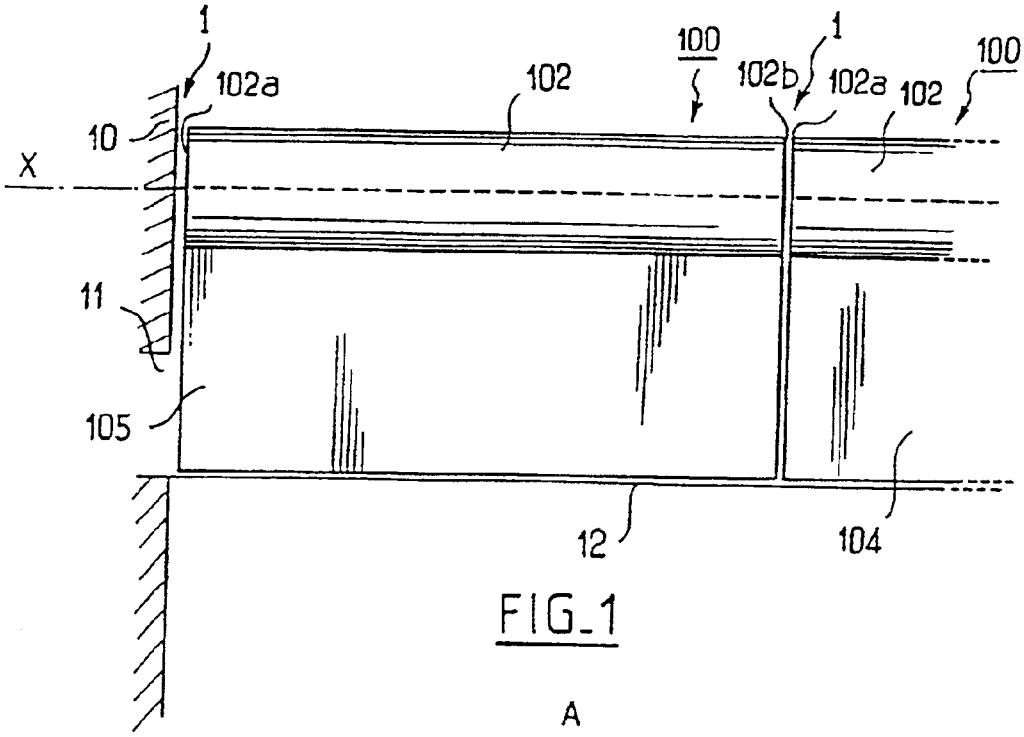
FIG. 1 is a sectional diagrammatic view along A—A of the device of FIG. 2.
Figure 2:
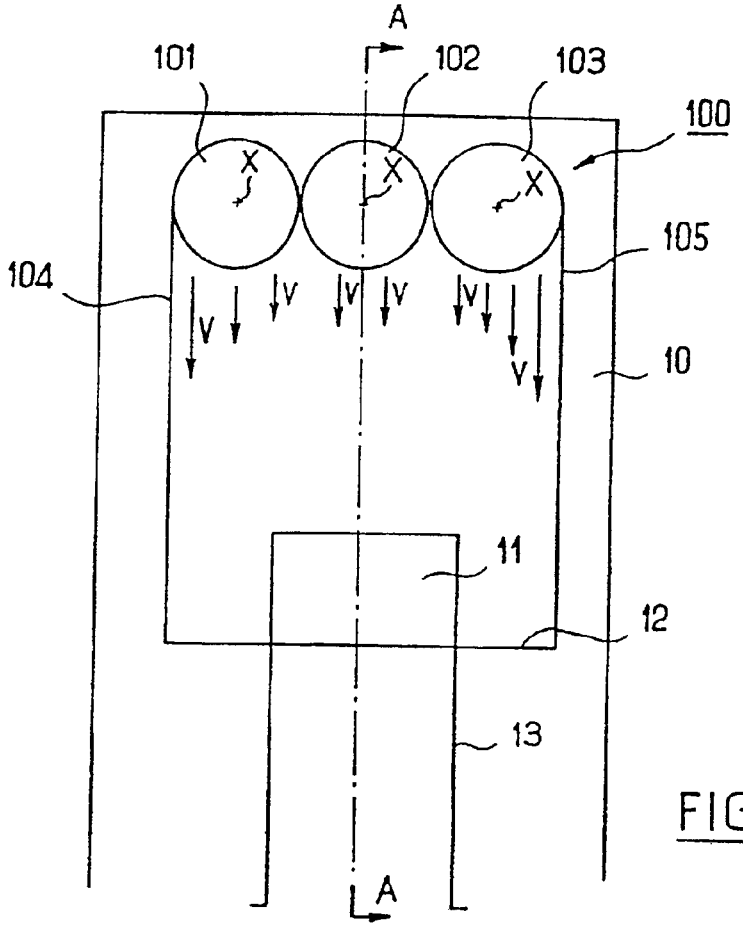
FIG. 2 is a front diagrammatic view of a first embodiment of a device according to the invention.

Represented in FIGS. 1 and 2 is a first embodiment of a device for the close protection of products arranged on a worktop 12 such as a conveyor, which are sensitive to contamination conveyed by the ambient environment. The worktop 12 rests on the ground by way of a foot 13.

This device 100 comprises a plurality of sheaths of flexible material 101, 102, 103, here three in number, juxtaposed above the worktop 12, along a direction transverse to the longitudinal edges of the worktop 12, in such a way that the X axes of the sheaths 101, 102, 103 are parallel and extend in one and the same plane parallel to the worktop 12.

The three juxtaposed sheaths 101, 102, 103 cover the width and the length of the worktop 12, and diffuse a stream of sterile air in a vertical direction substantially perpendicular to said worktop 12.

The sheaths are accordingly supplied with sterile air through individual air supply ducts (not represented) which open out in a leaktight manner into the sheaths through the topside of said sheaths.

The three identical sheaths 101, 102, 103 will not be described here in detail. They are of the type of those already described in international application WO 97/40325 belonging to the applicant.

In particular, each sheath 101, 102, 103 is formed of a semi-cylindrical quasi-leaktight upper wall and of a semi-cylindrical porous lower wall made from a perforated flexible material, extending longitudinally along the axis of the sheath and delimiting between them a cylindrical duct of axis X for supplying sterile air.

Furthermore, the external longitudinal edge of the quasi-leaktight upper wall of the sheath 101, 103 situated at each end of the juxtaposition of sheaths, is continued by a skirt 104, 105 which extends vertically toward the worktop and which constitutes a means of diffusing sterile air at high velocity (demarcated by the arrows v in FIG. 2) with respect to the porous lower walls of said sheaths which diffuse the sterile air at low velocity (demarcated by the arrows v in FIG. 2).

The mean velocity of the sterile air exiting the porous walls of the sheaths is of the order of 0.4 m/s.

According to the embodiment represented in FIGS. 1 and 2 the two skirts 104, 105 are of the same length and extend up to the immediate proximity of the worktop.

Figure 6:
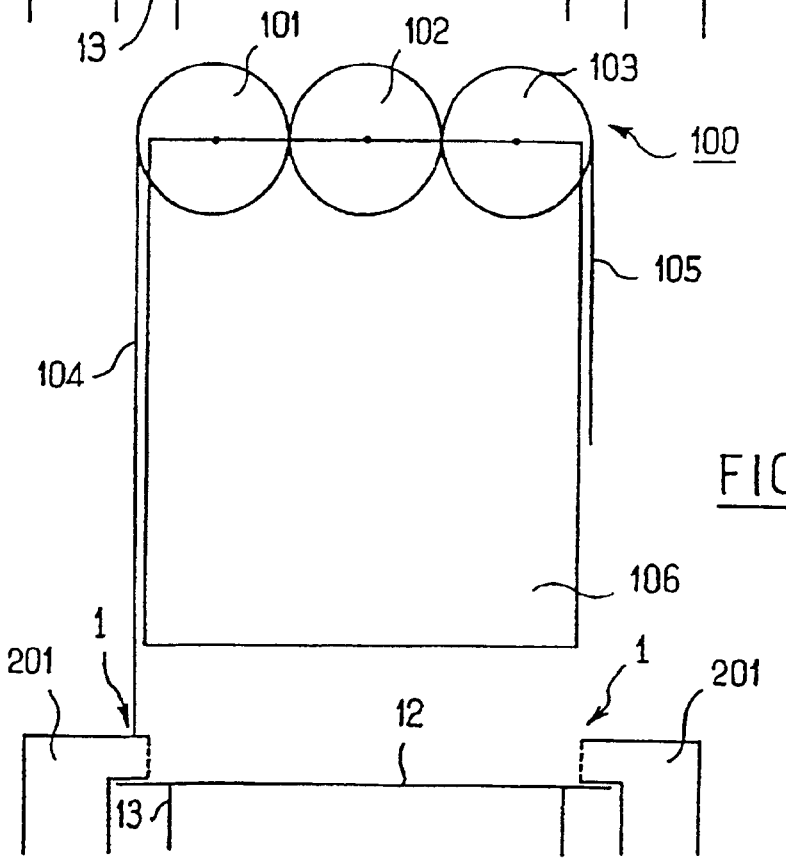
FIG. 6 is a front view of another assembly for close protection according to the invention.

According to a variant represented in FIG. 6, provision may be made for the two skirts 104, 105 to have different lengths, a long skirt 104 whose length is approximately equal to the height allowed for between the X axis of the sheath 101 and the worktop 12 and a short skirt 105 whose length is approximately equal to half the length of the long skirt 104.

Furthermore, each sheath 101, 102, 103 comprises an end 102*a* adjoining an outlet wall 10 of a machine, for example an oven, comprising an aperture 11 opening onto the worktop 12. This wall 10 rises vertically from ground and is taller than said sheaths.

Said ends of the sheaths 101, 102, 103 being made with discs of flat fabric, they adopt a domed shape under the pressure of the sterile air flowing in said sheaths.

There is then an air gap 1 between said ends of the sheaths 101, 102, 103 and the wall 10, and more particularly between the ends of the lateral skirts 104, 105 and the wall 10. This air gap 1 is around 30 to 35 mm.

To avoid any induction of contaminated air into said gap 1, each end 102*a* of each sheath 102 is formed by a porous wall made of a perforated flexible material.

A sterile air leakage directed outward away from the worktop 12 is thus created in said gap 1, this sterile air leakage countering any induction of ambient air into said gap 1 toward said worktop 12.

Said end wall 102*a* and the porous lower longitudinal wall of the sheath are made from a material of like porosity.

The perforated flexible material constituting the porous lower longitudinal wall of said end walls 102*a* of the sheaths 101, 102 and 103 is a synthetic fabric such as polypropylene or polyester fabric.

For worktops or conveyors of large length, there may be good cause to prolong each of the three juxtaposed flexible sheaths by abutting another similar sheath 102 with each sheath 102 aligned therewith (see FIG. 1, which shows a first embodiment of the invention). The two aligned sheaths 102 have no mechanical fixing therebetween.

Thus the other end 102*b* of each of the three juxtaposed sheaths, which is situated away from the end 102*a* adjoining the machine outlet wall 10, adjoins an end wall 102*a* of the other similar sheath 102.

An air gap 1 is then also created between the two end walls 102*b*, 102*a* adjoining the two abutting sheaths.

To avoid any induction of contaminated ambient air into this gap 1, one of the two adjoining ends 102*a*, 102*b* of the two aligned sheaths 102, is formed of a porous wall made of a perforated flexible material, for example of the type of that constituting the porous lower longitudinal wall of each sheath. Specifically, a leakage of sterile air outward away from the worktop is created through is porous end wall, countering any induction of contaminated air into said air gap 1.

Provision may also be made for the two adjoining end walls 102*a*, 102*b* of the two aligned sheaths 102 to be formed by porous walls made of a perforated flexible material. Two leakages of sterile air outward away from the worktop 12 are thus created in said air gap 1, countering any induction of contaminated air thereinto.

Figure 4:
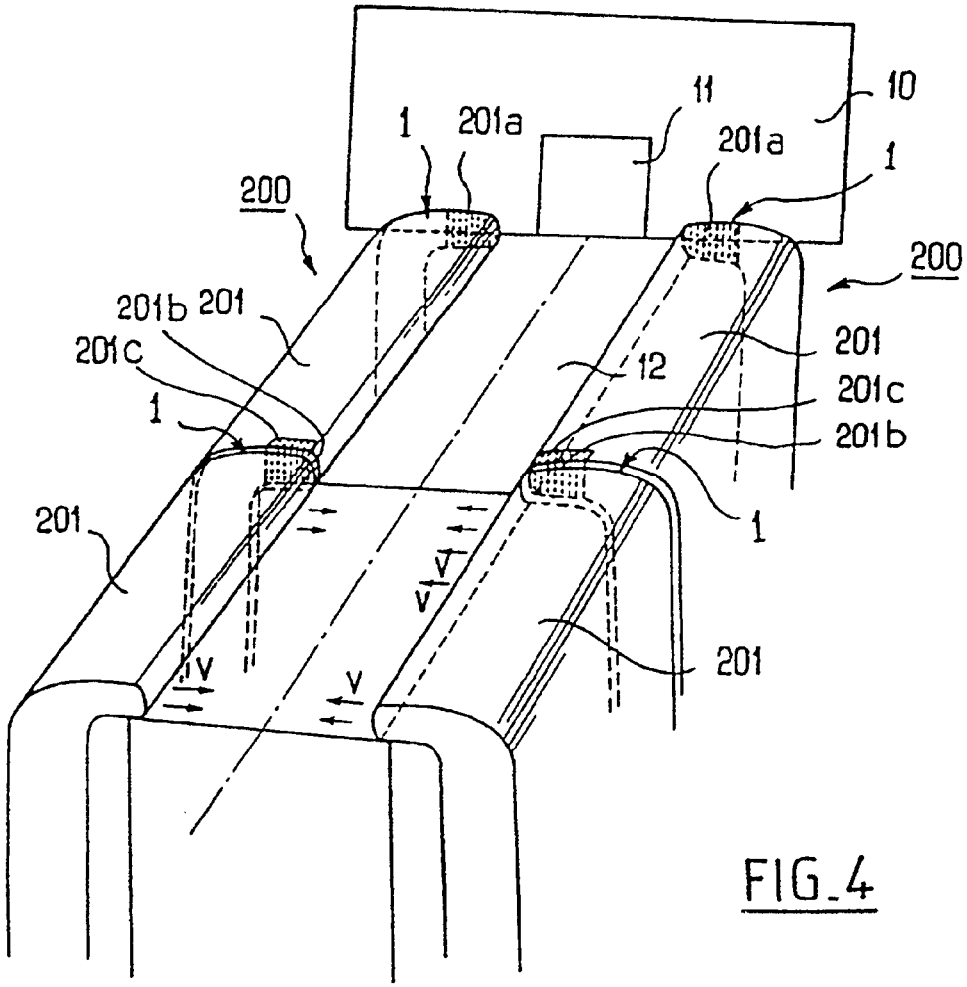
FIG. 4 is a perspective diagrammatic view of a second embodiment of the device according to the invention.

Represented in FIG. 4 is a second embodiment of a device 200 for the close protection of products arranged on a worktop such as a conveyor 12, which are sensitive to contamination by the ambient environment.

This device 200 comprises on each longitudinal edge of said worktop 12, two abutting ventilation nozzles 201 able to produce directed toward the sensitive products, a stream of sterile air in a horizontal general direction v substantially parallel to said worktop 12 (see FIG. 4).

Figure 3:
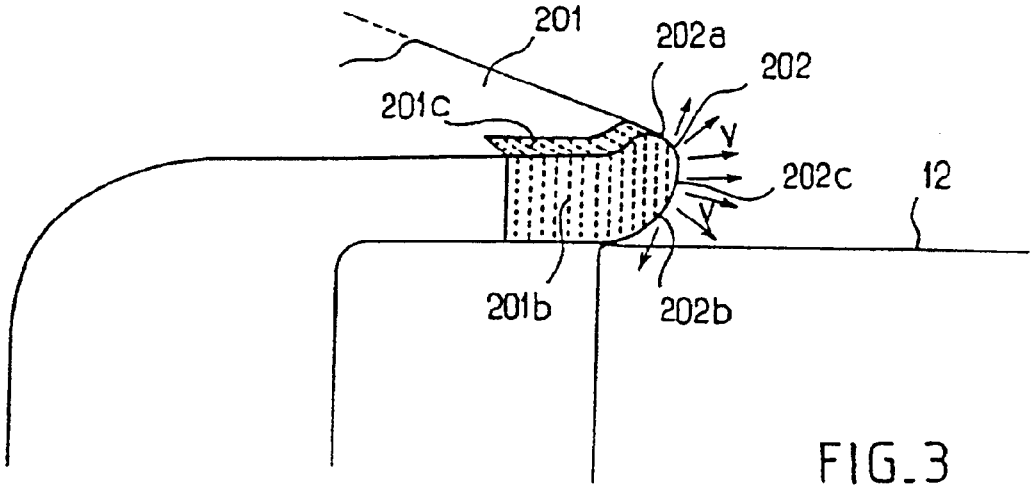
FIG. 3 is a view of a detail of an end of the device of FIG. 4.

As shown more particularly by FIG. 3, each ventilation nozzle 201 comprising at its outlet an air diffuser 202 made of a perforated material comprising upper 202*a* and lower 202*b* parts which produce an anti-inductive air flow whose velocity of diffusion exhibits a component normal to the worktop 12.

On each longitudinal edge of the worktop 12, a ventilation nozzle 201 has an end 201*a* adjoining an outlet wall 10 of a machine, for example an oven, which here has an aperture 11 opening onto the worktop 12, here a conveyor.

An air gap 1 is then also created between each end 201*a* of each nozzle and said wall.

To avoid an induction of contaminated air into this air gap 1, each end 201*a* of each ventilation nozzle 201 is formed by a porous wall made of a perforated material. This porous wall has a length of around 10 cm (see FIG. 3).

In particular, the end wall 201*a* of each ventilation nozzle 201 and the upper part 202*a* and lower part 202*b* of the air diffuser 202 are made from perforated sheet of like porosity.

This porous end setup makes it possible to create a leakage of sterile air outward away from the worktop, countering any induction of contaminated air into said air gap 1.

Moreover on each longitudinal edge of the conveyor 12, at the junction of the two abutting ventilation nozzles 201, there is an air gap 1 of a few millimeters between the two ends 201*b* of said nozzles.

To likewise avoid any phenomenon of induction of contaminated air into this air gap 1, one of the ventilation nozzles 201 comprises a porous end 201*b* and at the level of this porous end on its upper surface extending horizontally up to its outlet, a strip 201*c* of perforated material (see FIG. 3). The porous end 201*b* and said perforated strip 201*c* form a flow of sterile air directed essentially vertically away from the worktop 12.

The perforated strip 201*c* here has a width of 2 cm and a length of 10 cm.

Figure 5:
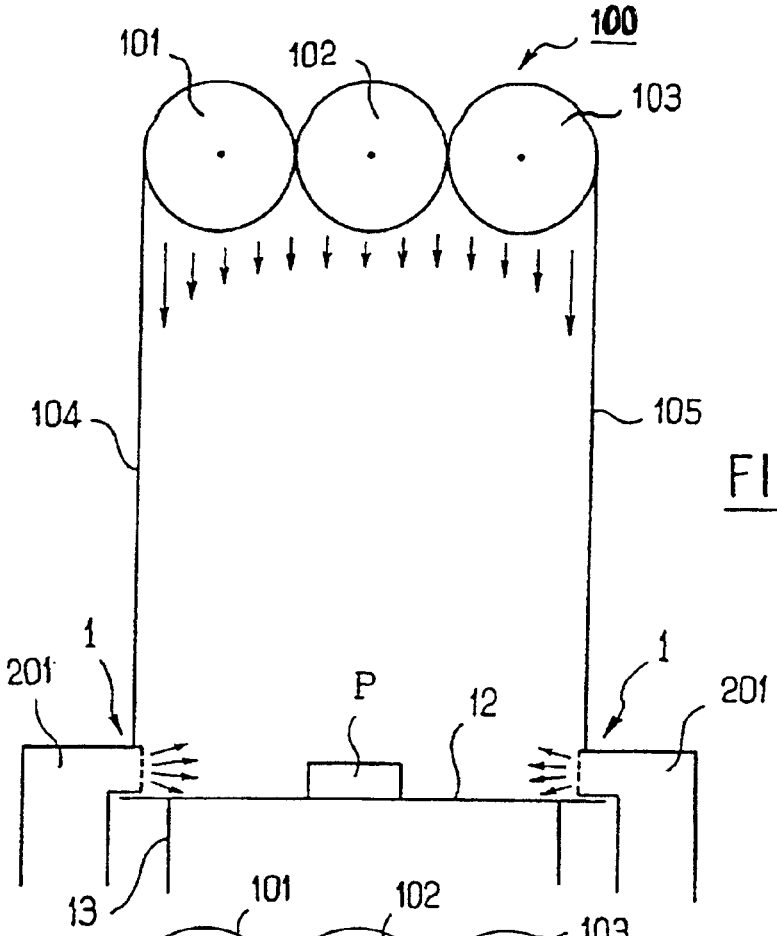
FIG. 5 is a front view of an assembly for close protection according to the invention.

Represented in FIG. 5 is an assembly for the close protection of products P arranged on a worktop 12 such as a conveyor, which are sensitive to the contamination conveyed by the ambient environment, which comprises a protection device 100 consisting of juxtaposed sheaths 101, 102, 103 made of flexible material, identical to the device represented in FIG. 2 and at the extremity of this device, a ventilation nozzle 201 arranged on each longitudinal edge of said worktop 12, able to produce directed toward said products P a stream of sterile air in a horizontal general direction substantially parallel to said worktop, each ventilation nozzle comprising at its outlet an air diffuser made of perforated material comprising upper and lower parts which produce an anti-inductive air flow whose velocity of diffusion exhibits a component normal to the worktop.

In this assembly, there are provided, as represented in FIG. 2, on either side of said sheaths, vertical skirts 104, 105 having identical lengths. The skirts extend here from the axis of the sheaths up to the longitudinal edges of the conveyor 12.

Moreover, each end of each skirt 104, 105 placed at the junction with the ventilation nozzles 201, is formed by a porous wall of perforated flexible material of the same type as that constituting the porous lower longitudinal walls of said sheaths.

The ends of the ventilation nozzles 201 are for their part made from a completely leaktight solid sheet.

This setup makes it possible to avoid any induction of contaminated air into the gap 1 created between the skirts and the ventilation nozzles. This gap is of the order of 20 mm taken between the vertical lateral skirts and the nozzles.

Represented in FIG. 6 is a variant of the assembly for close protection of FIG. 5, according to which there are provided, on either side of the juxtaposed flexible sheaths 101, 102, 103, vertical skirts of different lengths, a long skirt 104 whose length is approximately equal to the height allowed for between the axis of the sheaths and the worktop and a short skirt 105 whose length is approximately equal to half the length of the long skirt.

There is moreover provided a vertical end skirt 106 extending in front of the ends of the sheaths, from the axes of said sheaths, in a plane perpendicular to the planes of the vertical lateral skirts 104, 105, directed toward said worktop 12 up to a determined distance from the latter so as to allow the passage of said products under said end skirt 106.

The ends of said sheaths remain porous walls and the ends of the ventilation nozzles situated on the sheaths side remain leaktight.

This novel setup makes it possible to avoid any induction of contaminated air into the gap 1 created between the sheaths and the ventilation nozzles, especially on the short lateral skirt 105 side.

Figure 7:
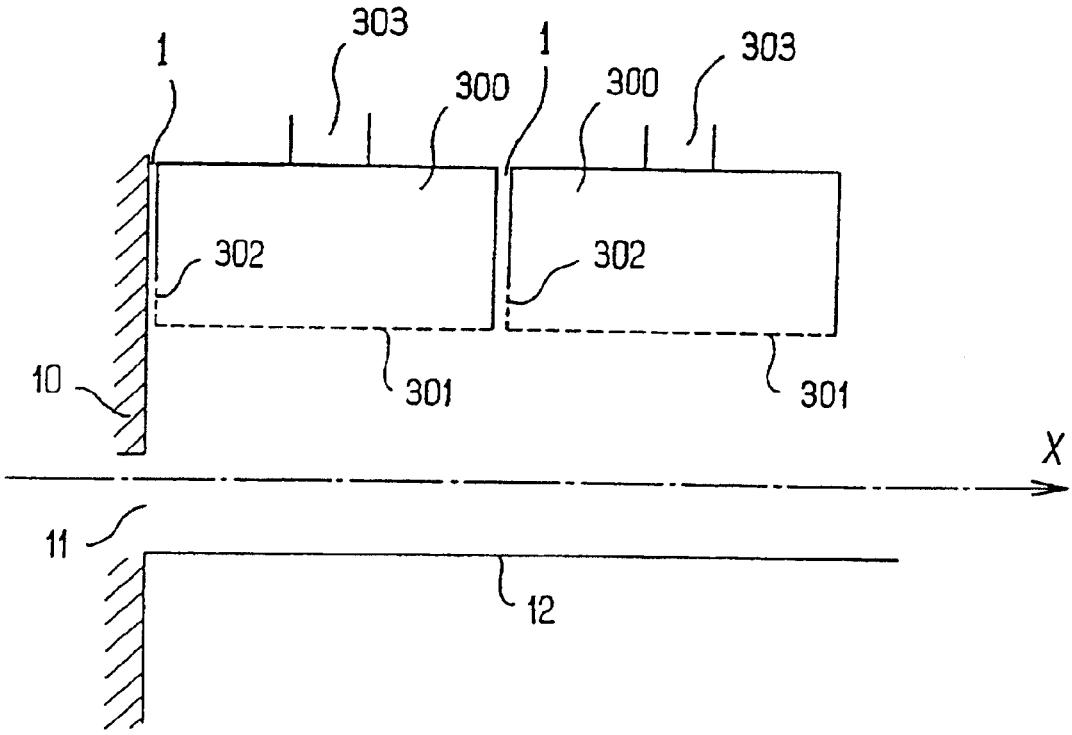
FIG. 7 is a longitudinal sectional view of a third embodiment according to the invention.

Represented in FIG. 7 is a cubicle 300 positioned above the worktop 12, supplied with sterile air through a duct 303 which opens into the cubicle through its leaktight upper wall. This cubicle 300 has a porous lower wall 301 for diffusing sterile air in a vertical direction substantially perpendicular to the worktop 12, said porous wall 301 being made from a perforated sheet and exhibiting a profile such that it ensures a central diffusion of sterile air at low velocity bordered on each side by a diffusion of sterile air at high velocity. An end of the cubicle 300 adjoins an outlet wall 10 of a machine. Here this outlet wall 10 comprises an aperture 11 opening into the worktop 12. This end is formed by a wall comprising at least one porous zone 302 made of perforated material extending over the entire width of said cubicle 300 and rising from the lower edge of said cubicle 300 to a certain determined height here of the order of 25 mm.

Furthermore, the cubicle 300 is prolonged axially by another identical cubicle 300 which is abutted with the first cubicle without mechanical fixing with the latter.

The end of the second cubicle 300 which adjoins the leaktight end of the first cubicle 300 comprises a porous zone 302 made of perforated material extending over the width of said cubicle 300 and rising from the lower edge of said cubicle to a certain determined height here of the order of 25 mm.

The porosity of the porous zone 302 of the ends of the lower walls for diffusing sterile air 301 of the cubicles 300, are in this typical case identical.

These end setups of the cubicles also make it possible to avoid inductions of contaminated air into the air gaps 1 created between the wall 10 and the first cubicle and between the two ends of the abutting cubicles, by creating air leakages directed outward away from the worktop 12, countering the flow of incoming air.

In general, the quality of the air in respect of the worktop and in respect of the various embodiments described earlier of the protection device according to the invention, at the junction of the ends of this device with various wall types, is class 10 for 0.3 $\mu$m particles, this being a guarantee of a sterile ambient environment, in particular according to the standard US Fed Std 209 E of 1992.

The present invention is in no way limited to the embodiments described and represented, but the person skilled in the art will be able to provide any variant thereof in accordance with the spirit thereof.

We claim:

1. An installation comprising:

a worktop;

a first wall; and a device for the close protection of products arranged on the worktop, which are sensitive to contamination from the ambient environment, by diffusion of a sterile air stream in a direction substantially perpendicular or parallel to said worktop, said device extending along said worktop and having at least one end adjoining the first wall so that there is an air gap between said end and said first wall, wherein said end is formed by a porous second wall made of a perforated material, extending substantially perpendicularly to a longitudinal axis of said device, in such a way as to create in said air gap a sterile air leakage directed outward away from the worktop, the sterile air leakage countering any ambient air induction into said air gap toward said worktop.

2. The installation as claimed in claim 1, wherein said first wall is a machine outlet wall provided with an aperture opening onto the worktop.

3. The installation as claimed in claim 1, wherein said first wall is an end wall of another similar device with which it forms a set of devices for the close protection of products arranged on a worktop of large length, which are sensitive to the contamination conveyed by the ambient environment, said devices being abutted without mechanical fixing therebetween.

4. The installation as claimed in claim 3, wherein said first wall is a porous wall made of a perforated material through which is created a sterile air leakage directed outward away from said worktop.

5. The device as claimed in claim 1, further comprising at least one sheath made of a flexible material diffusing a sterile air stream in a vertical direction substantially perpendicular to said worktop (12), said sheath being formed of a quasi-leaktight upper wall and of a porous lower wall made of a perforated flexible material, extending longitudinally along the axis (X) of the sheath and delimiting between them a sterile air supply duct, and said end of the sheath being formed by a porous wall made of a perforated flexible material.

6. The installation as claimed in claim 1, wherein said end wall and the porous lower longitudinal wall of the sheath are made from a material of like porosity.

7. The installation as claimed in claim 1, wherein the perforated flexible material constituting the porous lower longitudinal wall and said end wall of the sheath is a synthetic fabric.

8. The installation as claimed in claim 1, wherein each longitudinal edge of the quasi-leaktight upper longitudinal wall of said sheath is continued by skirts which extend vertically toward the worktop and which constitutes the means of diffusion of sterile air at high velocity relative to the porous lower longitudinal wall of the sheath which diffuses the sterile air at low velocity.

9. The installation as claimed in claim 5, further comprising a plurality of sheaths made of a flexible material, juxtaposed so that their axes (X) are parallel and arranged in one and the same plane parallel to the worktop, said sheaths covering the entire width of said worktop.

10. The installation as claimed in claim 9, wherein the external longitudinal edge of the quasi-leaktight upper wall of the sheath situated at each end of the juxtaposition of sheaths, is continued by skirts which extend vertically toward the worktop and which constitute a means of diffusion of sterile air at high velocity relative to the porous lower walls of said sheaths which diffuse the sterile air of low velocity.

11. The device as claimed in claim 8, characterized in that the skirts are of the same length and extend up to the immediate proximity of the worktop.

12. The installation as claimed in claim 8, wherein the at least two skirts have different lengths, a long skirt whose length is approximately equal to the height allowed for between the axis of the sheath and the worktop and a short skirt whose length is approximately equal to half the length of the long skirt.

13. The installation as claimed in claim 1, further comprising at least one ventilation nozzle arranged on a longitudinal edge of said worktop and able to produce directed toward said products a sterile air stream in a horizontal general direction substantially parallel to said worktop, said ventilation nozzle comprising at its outlet an air diffuser made of a perforated material provided with upper and lower parts which produce an anti-inductive air flow whose velocity of diffusion exhibits a component normal to the worktop, an end of said ventilation nozzle being formed by a wall made of a perforated material.

14. The installation as claimed in claim 1, wherein said end wall of the ventilation nozzle and the upper part and lower part of the air diffuser are made from a perforated sheet of like porosity.

15. The installation as claimed in claim 1, wherein the ventilation nozzle comprises at the level of said porous end on its upper surface extending horizontally up to its outlet, a strip of perforated material forming a sterile air flow directed essentially vertically away from the worktop.

16. The installation as claimed in claim 1, further comprising: a cubicle positioned above the worktop, supplied with sterile air and having a porous lower wall for diffusing sterile air in a vertical direction substantially perpendicular to the worktop, said porous wall being made of perforated sheet and exhibiting a profile such that it ensures central diffusion of sterile air at low velocity bordered on each side by a diffusion of sterile air at high velocity, said end of the cubicle being formed by a wall comprising at least one porous zone made of a perforated material extending over the entire width of said cubicle and rising from the lower edge of said cubicle to a certain determined height.

17. The installation as claimed in claim 16, wherein said height is of the order of 25 mm.

18. An installation comprising:

a worktop;

a first wall; and a device for the close protection of products arranged on the worktop, which are sensitive to the contamination conveyed by the ambient environment, by diffusion of a sterile air stream in a direction substantially perpendicular or parallel to said worktop, said device extending along said worktop and having at least one end adjoining the first wall so that there is an air gap between said end and said first wall, wherein said end is formed by a porous second wall made of a perforated material, extending substantially perpendicularly to a longitudinal axis of said device, in such a way as to create in said air gap a sterile air leakage directed outward away from the worktop, the sterile air leakage countering any ambient air induction into said air gap toward said worktop, at least one sheath made of a flexible material diffusing a sterile air stream in a vertical direction substantially perpendicular to said worktop, said sheath being formed of a quasi-leaktight upper wall and of a porous lower wall made of a perforated flexible material, extending longitudinally along an axis of said sheath and delimiting between them a sterile air supply duct, and said end of said sheath being formed by a porous wall made of a perforated flexible material;

at least two skirts which extend vertically toward the worktop and which constitute a means of diffusion of sterile air at high velocity relative to the porous lower longitudinal wall of said sheath which diffuses the sterile air at low velocity;

at least one ventilation nozzle arranged on a longitudinal edge of said worktop, able to produce directed toward said products a sterile air stream in a horizontal general direction substantially parallel to said worktop, said ventilation nozzle comprising at its outlet an air diffuser made of perforated material comprising upper and lower parts which produce an anti-inductive air flow whose velocity of diffusion exhibits a component normal to the worktop, said device furthermore comprising at the junction with said ventilation nozzle a vertical end skirt extending in a plane perpendicular to the planes of the lateral skirts of said sheath, directed toward said worktop up to a determined distance therefrom so as to permit the passage of said products under said end skirt; and a vertical end skirt disposed at a junction with said ventilation nozzle and extending in a plane perpendicular to the planes of the at least two skirts, said vertical end skirt directed toward said worktop up to a determined distance therefrom so as to permit the passage of said products under said vertical end skirt, wherein each longitudinal end of the quasi-leaktight upper longitudinal wall of said sheath is constituted by a corresponding one of said at least two skirts, and wherein the at least two skirts have different lengths, a long skirt whose length is approximately equal to the height allowed for between the axis of the sheath and the worktop and a short skirt whose length is approximately equal to half the length of the long skirt.

19. An installation comprising:

a worktop;

a first wall;

a device for the close protection of products arranged on the worktop, which are sensitive to contamination from the ambient environment, by diffusion of a sterile air stream in a direction substantially perpendicular or parallel to said worktop, said device extending along said worktop and having at least one end adjoining the first wall so that there is an air gap between said end and said first wall;

at least two skirts which extend vertically toward the worktop and which constitute a means of diffusion of sterile air at high velocity relative to the porous lower longitudinal wall of said sheath which diffuses the sterile air at low velocity;

at least one ventilation nozzle arranged on a longitudinal edge of said worktop, able to produce directed toward said products a sterile air stream in a horizontal general direction substantially parallel to said worktop, said ventilation nozzle including at its outlet an air diffuser made of perforated material comprising upper and lower parts which produce an anti-inductive air flow whose velocity of diffusion exhibits a component normal to said worktop, said ventilation nozzle being disposed at an extremity of said device; and a vertical end skirt disposed at a junction with said ventilation nozzle and extending in a plane perpendicular to the planes of the at least two skirts, said vertical end skirt directed toward said worktop up to a determined distance therefrom so as to permit the passage of said products under said vertical end skirt.

20. An installation comprising:

a worktop;

a first wall; and a device for the close protection of products arranged on the worktop, which are sensitive to contamination from the ambient environment, by diffusion of a sterile air stream in a direction substantially perpendicular or parallel to said worktop, said device extending along said worktop and having at least one end adjoining the first wall so that there is an air gap between said end and said first wall, wherein said end is formed by a porous second wall made of a perforated material, extending substantially perpendicularly to a longitudinal axis of said device, in such a way as to create in said air gap a sterile air leakage directed outward away from the worktop, the sterile air leakage countering any ambient air induction into said air gap toward said worktop;

at least one sheath made of a flexible material diffusing a sterile air stream in a vertical direction substantially perpendicular to said worktop, said sheath being formed of a quasi-leaktight upper wall and of a porous lower wall made of a perforated flexible material, extending longitudinally along an axis of said sheath and delimiting between them a sterile air supply duct, and said end of the sheath being formed by a porous wall made of a perforated flexible material;

at least two skirts which extend vertically toward the worktop and which constitute a means of diffusion of sterile air at high velocity relative to the porous lower longitudinal wall of said sheath which diffuses the sterile air at low velocity;

at least one ventilation nozzle arranged on a longitudinal edge of said worktop, able to produce directed toward said products a sterile air stream in a horizontal general direction substantially parallel to said worktop, said ventilation nozzle including at its outlet an air diffuser made of perforated material comprising upper and lower parts which produce an anti-inductive air flow whose velocity of diffusion exhibits a component normal to said worktop, said ventilation nozzle being disposed at an extremity of said device; and a vertical end skirt disposed at a junction with said ventilation nozzle and extending in a plane perpendicular to the planes of the at least two skirts, said vertical end skirt directed toward said worktop up to a determined distance therefrom so as to permit the passage of said products under said vertical end skirt, and wherein each longitudinal end of the quasi-leaktight upper longitudinal wall of said sheath is constituted by a corresponding one of said at least two skirts, wherein the at least two skirts are of substantially the same length and extend up to in immediate proximity of said worktop.

* * * * *